US006642905B2

(12) United States Patent
Bien et al.

(10) Patent No.: US 6,642,905 B2
(45) Date of Patent: Nov. 4, 2003

(54) THERMAL-LOCATE 5W(V) AND 5W(H) SSPA'S ON BACK OF REFLECTOR(S)

(75) Inventors: Albert Louis Bien, Anaheim, CA (US); Glenn J. Desargant, Fullerton, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/034,984

(22) Filed: Dec. 21, 2001

(65) Prior Publication Data

US 2003/0117335 A1 Jun. 26, 2003

(51) Int. Cl.[7] ..... H01Q 13/00
(52) U.S. Cl. ..... 343/840; 343/781 R; 343/772
(58) Field of Search ..... 343/840, 772, 343/786, 882, 755, 781, 705

(56) References Cited

U.S. PATENT DOCUMENTS 4,258,366 A * 3/1981 Frosch et al. ..... 343/786
5,760,749 A * 6/1998 Minowa et al. ..... 343/772
6,496,156 B1 * 12/2002 Lusignan et al. ..... 343/781 R

* cited by examiner

*Primary Examiner*—James Clinger
(74) *Attorney, Agent, or Firm*—Harness Dickey & Pierce P.L.C.

(57) ABSTRACT

A microwave antenna for an aircraft including a reflector element with a front surface and a rear surface. A horn is mounted to the front surface of the reflector element and an orthomode transducer is mounted to the rear surface of the reflector element. The orthomode transducer is coupled to the horn. Solid state power amplifiers that amplify a microwave signal to be transmitted and low noise amplifiers that amplify a received microwave signal are coupled to the orthomode transducer. The solid state amplifiers and the low noise amplifiers are also located on the rear surface of the reflector element.

16 Claims, 2 Drawing Sheets

THERMAL-LOCATE 5W(V) AND 5W(H) SSPA'S ON BACK OF REFLECTOR(S)

FIELD OF THE INVENTION

The present invention relates to a microwave reflector antenna and, more specifically, to a microwave reflector antenna for attachment to an aircraft.

BACKGROUND OF THE INVENTION

Microwave reflector antennas can be used in airborne applications. For example, microwave reflector antennas can be used on an aircraft to allow the aircraft to communicate with other parties. When the microwave reflector antenna is used on an aircraft, the microwave reflector antenna may be positioned on the crown of the exterior of the aircraft. The positioning of the microwave reflector antenna on the exterior of the aircraft increases the drag of the aircraft as it travels through the atmosphere and exposes the microwave reflector antenna to the harsh environments that the aircraft is exposed to. Therefore, the microwave reflector antennas are typically covered by a radome which completely covers the microwave reflector antenna and reduces the drag caused by positioning the microwave reflector antenna on the exterior of the aircraft.

Because the cost of the radome is proportional to the size of the radome, any reduction in the height of the radome will result in a cost savings. Additionally, decreasing the size of the radome will also decrease the drag caused by the radome on the aircraft. Therefore, it is desirable to reduce the height of the microwave reflector antenna so that the height of the radome can also be reduced.

Additionally, RF components such as orthomode transducers (OMT's), solid state power amplifiers (SSPA's), and low noise amplifiers (LNA's) are often used in reflector antennas. These components typically are remotely located from the antenna. However, if the RF components are remotely located from the antenna, the waveguide which interconnects the antenna to the RF components will introduce higher RF losses. RF losses occur because the RF components are typically located by a distance of many feet away from the antenna and the interconnecting waveguide is too long. Waveguides are also difficult to fabricate, costly, heavy, and difficult to install into aircraft.

Furthermore, the use of a waveguide to connect the antenna to the remotely located RF components requires a waveguide azimuth rotary joint. A rotary joint is used to interconnect the movable antenna to the stationary aircraft fuselage. A waveguide rotary joint is considerably larger and more costly than a coaxial rotary joint. As a result, antennas that use a waveguide rotary joint are larger and increase drag.

Therefore, a microwave reflector antenna that utilizes RF components mounted directly onto the antenna is needed so the antenna has a minimum height, minimum RF losses, and so the antenna may utilize a coaxial rotary joint. Also, if the antenna has a minimum height, the radome necessary to cover the antenna will also be of a minimum size which will reduce the cost to build and operate a microwave antenna, reduce aerodynamic drag, and reduce the swept volume of the microwave antenna.

SUMMARY OF THE INVENTION

The present invention provides a microwave antenna for an aircraft including a reflector element with a front surface and a rear surface. A horn is mounted to the front surface of the reflector element and an orthomode transducer is mounted to the rear surface of the reflector element. The orthomode transducer is coupled to the horn. Solid state power amplifiers that amplify a microwave signal to be transmitted and low noise amplifiers that amplify a received microwave signal are coupled to the orthomode transducer. The solid state amplifiers and the low noise amplifiers are also located on the rear surface of the reflector element.

The inherent advantage of this design is that it permits the use of smaller RF components such as the LNA's and the SSPA's. These lower wattage units have less concentrated heat to dissipate, can be readily mounted directly onto the antenna and result in the lowest possible RF losses.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
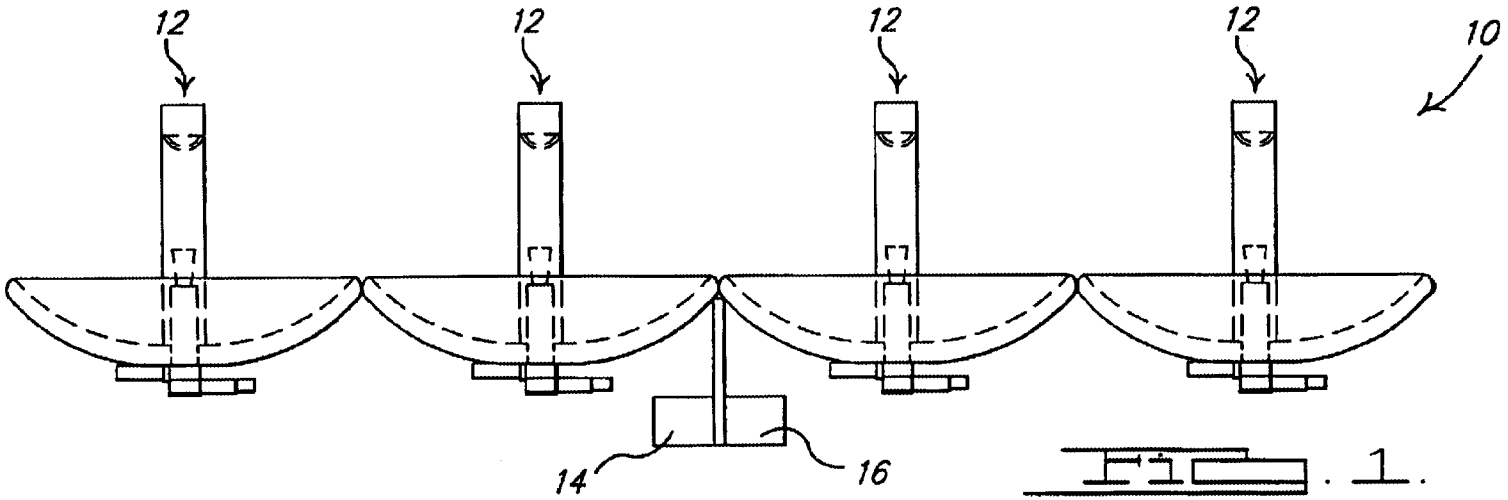
FIG. 1 is a top view of a microwave antenna array of the present invention.

Referring to FIG. 1, a linear array 10 of microwave antennas 12 is shown. Although an array 10 of four microwave antennas 12 is shown, any number of microwave antennas 12 may be used and is not out of the scope of the present invention.

The array 10 is capable of rotating about two different axis. A first axis of rotation is an azimuth axis. Rotation of the array 10 about the azimuth axis allows the array 10 to rotate 360° so that the array 10 can point in any direction along the horizon. A second axis of rotation is the elevation axis. Rotation of the array 10 about the elevation axis allows the elevation of the array 10 to be adjusted so that the array 10 can be oriented between the horizon and the sky.

In order to rotate the array 10 about the azimuth axis, the array 10 is connected to an azimuth stepper motor 14. In order to rotate the array 10 about the elevation axis, the array is also connected to an elevation stepper motor 16. It should be noted that any azimuth stepper motor 14 or any elevation stepper motor 16 may be used that is known in the art.

Figure 2B:
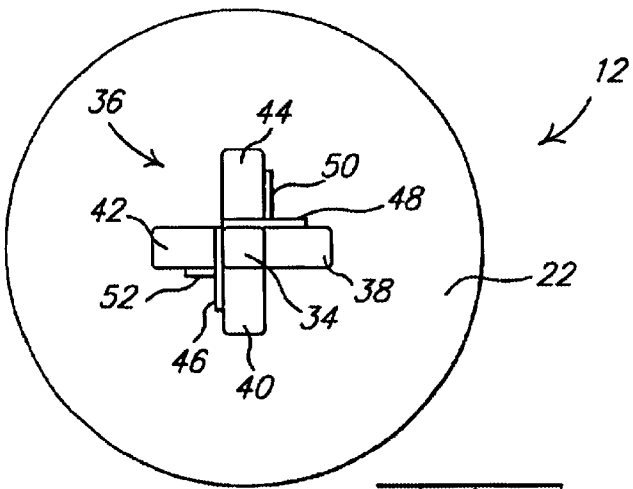
FIG. 2*b* is a rear view of a microwave antenna of the present invention.
Figure 2A:
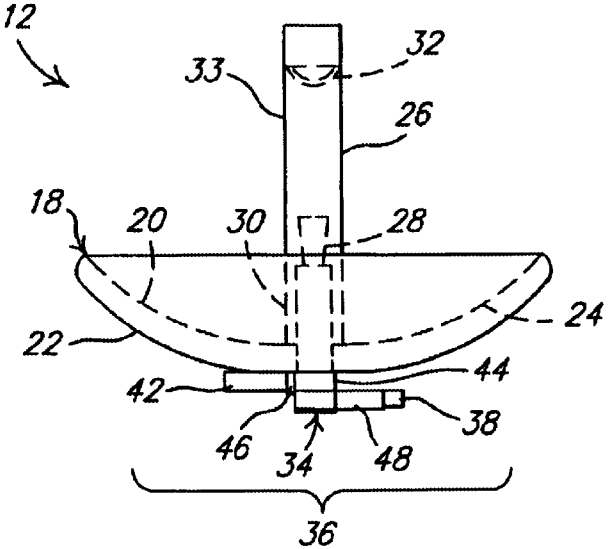
FIG. 2*a* is a side view of a microwave antenna of the present invention.

FIGS. 2*a* and 2*b* show a preferred embodiment of a microwave antenna 12 that is used in the array 10.

As can be seen in FIG. 2*a,* the microwave antenna 12 includes a reflector element 18 that has reflective surface 20 and a back surfaces 22. A portion 24 of the front surface 20 is concave and reflects microwave energy that strikes the concave portion 24 of the front surface 20. Preferably, the back surface 22 of the reflector element 18 is convex, however, the back surface 22 does not need to be convex to be within the scope of the invention. A preferably plastic support tube 26 extends radially outward from the front surface 20 of the reflector element 18. A wide band horn 28, shown in phantom, is also positioned on the front surface 20 of the reflector element 18 proximate a rear portion 30 of the support tube 26. More particularly, the horn 28 is located within the rear portion 30 of the support tube 26. A sub-reflector 32, shown in phantom, is positioned in front of the horn 28 proximate a front portion 33 of the support tube 26. More particularly, the sub-reflector 32 is located within the front portion 33 of the support tube 26. The horn 28 emits microwave energy which is directed at the sub-reflector 32. The sub-reflector 32 reflects the microwave energy towards the concave portion 24 of the front surface 20 of the reflector element 18. The concave portion 24 of the front surface 20 of the reflector element 18 then reflects the microwave energy in a desired direction.

The horn 28 receives microwave energy that is directed by the sub-reflector 32. The concave portion 24 of the front surface 20 of the reflector element 18 reflects the microwave energy toward the sub-reflector 32. The sub-reflector 32 then reflects the microwave energy toward the horn 28.

The reflector element 18 is preferably a Cassegrain reflector, but may be any reflector element 18 that is known in the art that can perform a transmit function (TX) and receive function (RX).

The horn 28 is preferably a corrugated horn, but may be any horn 28 that is known in the art.

An orthomode transducer (OMT) 34 extends from a back surface 22 of the reflector element 18 and is directly coupled to the horn 28. OMT 34 is a device that serves to combine or separate orthogonally polarized signals. The orthogonally polarized signals may have a vertical polarization or a horizontal polarization.

As can also be seen in FIG. 2*b,* RF components 36 such as solid state power amplifiers (SSPA's) 38, 40 and low noise amplifiers (LNA's) 42, 44 are located on the back surface 22 of the reflector element 18 and are adjacently mounted to the OMT 34. The configuration of the RF components 36 is merely exemplary and should not be limited to that illustrated.

The SSPA's 38, 40 serve to amplify the transmission signal. A vertical polarization SSPA 38 is mounted orthogonally relative to the OMT 34 and amplifies a vertical polarization of the signal to be transmitted. A horizontal polarization SSPA 40 is mounted orthogonally relative to the OMT 34 and amplifies a horizontal polarization of the signal to be transmitted.

The LNA's 42, 44 serve to amplify the signal that is received. A vertical polarization LNA 42 is mounted orthogonally relative to the OMT 34 and amplifies a vertical polarization of the signal that is received. A horizontal polarization LNA 44 is mounted orthogonally relative to the OMT 34 and amplifies a horizontal polarization of the signal that is received.

In other words, the vertical polarization SSPA 38 and the vertical polarization LNA 42 radially extend from the OMT 34, opposite one another. The horizontal polarization SSPA 40 and the horizontal polarization LNA 44 also radially extend from the OMT 34, opposite one another. The vertical polarization SSPA 38 is orthogonally adjacent to both the horizontal polarization SSPA 40 and the horizontal polarization LNA 44. The vertical polarization LNA 42 is also orthogonally adjacent to both the horizontal polarization SSPA 40 and the horizontal polarization LNA 44.

Figure 3:
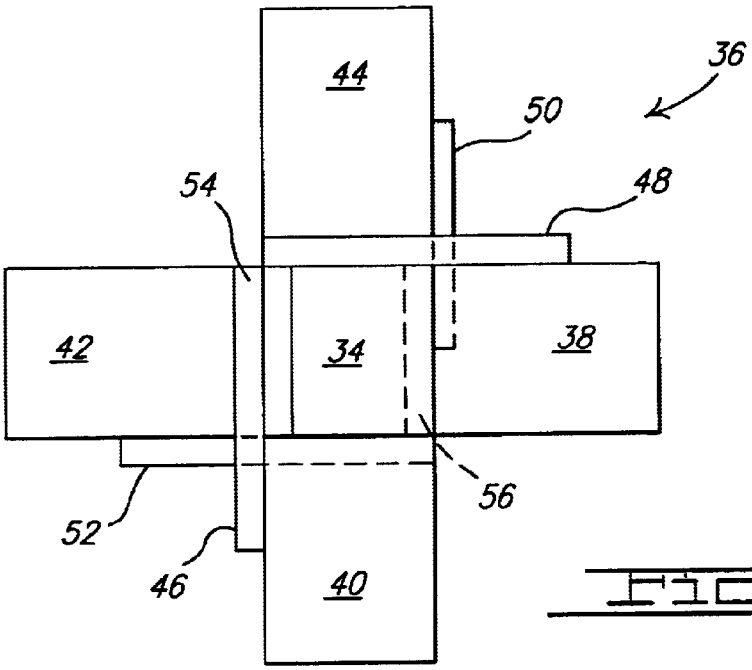
FIG. 3 is a schematic view of RF components mounted to the microwave antenna.

Now referring to FIG. 3, the OMT 34 is connected to short sections of ½ height waveguide 46, 48, 50, and 52 via circulators 54, 56. The first circulator 54 is used for TX (transmission function) and the second circulator 56 is used for RX (receive function). The first circulator 54 (for TX) is connected to a TX-H waveguide 46 and to a TX-V waveguide 48. The TX-H waveguide 46 carries the horizontal polarization state of the signal to be transmitted. The TX-V waveguide 48 carries the vertical polarization state of the signal to be transmitted. The TX-H waveguide 46 is further connected to the horizontal polarization SSPA 40. The TX-V waveguide 48 is further connected to the vertical polarization SSPA 38.

The second circulator 56 (for RX), shown in phantom, is connected to a RX-H waveguide 50 and to a RX-V waveguide 52. The RX-H waveguide 50 carries the horizontal polarization state of the received signal. The RX-V waveguide 52 carries the vertical polarization state of the received signal. The RX-H waveguide 50 is further connected to the horizontal polarization LNA 44. The RX-V 52 waveguide is further connected to the vertical polarization LNA 42.

Figure 4:
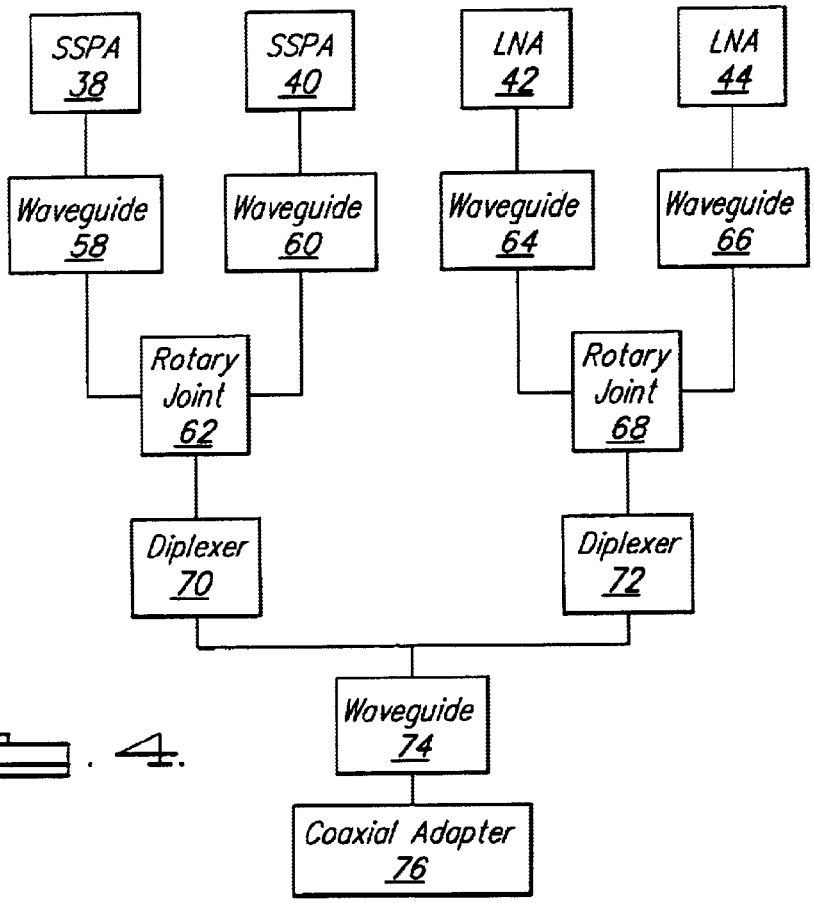
FIG. 4 is a block diagram of RF components connected to a coaxial adapter.

Referring to FIG. 4, the SSPA's 38, 40 are connected to ½ height waveguides 58, 60 that run to a single channel elevation waveguide rotary joint 62. The LNA's 42, 44 are also connected to ½ height waveguides 64, 66 that run to another single channel waveguide rotary joint 68. The RX signals and TX signals pass then pass through diplexers 70, 72 and through a waveguide 74 to a coaxial adapter 76. This design permits both signals (TX and RX) to pass through a coaxial rotary joint (not shown) and then on to the RF processing system that is located within the fuselage of the aircraft.

The SSPA's 38, 40 and LNA's 42, 44 used in the present invention are preferably 5 watt amplifiers. These lower wattage components have less concentrated heat to dissipate and can be readily mounted directly onto the back surface 22 of the reflector element 18 as a result of their small size. By mounting the RF components 36 directly onto the back surface 22 of the reflector element 18, RF losses are kept to a minimum as a result of the signal being immediately amplified by the SSPA's 38, 40 and the LNA's 42, 44. By amplifying the signal immediately (rather than after passing through waveguides), a much stronger signal travels through waveguides 58, 60, 64, and 66 to the single channel elevation rotary joints 62, 68.

Furthermore, mounting the RF components 36 to the back surface 22 of the reflector element 18 enables using a coaxial rotary joint as opposed to an waveguide azimuth rotary joint which reduces antenna height and swept volume. The minimization of the microwave antenna 12 also lowers the size of the radome and aerodynamic drag, which in turn lowers the cost to build and operate the microwave antenna 12.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A microwave antenna for an aircraft comprising:

a reflector element with reflective surface and a back surface; and a plurality of RF components including an orthomode transducer, two solid state power amplifiers, and two low noise amplifiers, wherein the RF components are mounted to the back surface of the reflector element.

2. The microwave antenna according to claim 1, wherein the solid state power amplifier and low noise amplifiers further comprise 5 watt amplifiers.

3. The microwave antenna according to claim 1, further comprising:

at least one first waveguide connected between the orthomode transducer and the solid state power amplifiers; and at least one second waveguide connected between the orthomode transducer and the low noise amplifiers.

4. The microwave antenna according to claim 3, wherein the first and second waveguide further comprise ½ height waveguides.

5. The microwave antenna according to claim 1, further comprising a coaxial adapter disposed between the RF components and a coaxial rotary joint, said coaxial rotary joint disposed between the antenna and the aircraft.

6. A microwave antenna for an aircraft comprising:

a reflector element with reflective surface and a back surface;

a horn mounted to the front surface of the reflector element;

an orthomode transducer mounted to the back surface of the reflector element, the orthomode transducer coupled to the horn;

a first solid state power amplifier located on the back surface of the reflector element and coupled to the orthomode transducer;

a second solid state power amplifier located on the back surface of the reflector element and coupled to the orthomode transducer;

a first low noise amplifier located on the back surface of the reflector element and coupled to the orthomode transducer; and a second low noise amplifier located on the back surface of the reflector element and coupled to the orthomode transducer.

7. The microwave antenna according to claim 6, wherein the first and second solid state power amplifiers and first and second low noise amplifiers further comprises 5 watt amplifiers.

8. The microwave antenna according to claim 6, further comprising:

a first set of two waveguides connected between the orthomode transducer to the solid state amplifiers; and a second set of two waveguides connected between the orthomode transducer to the low noise amplifiers.

9. The microwave antenna according to claim 8, wherein the first and second set of waveguides further comprise ½ height waveguides.

10. The microwave antenna according to claim 6, further comprising a coaxial adapter disposed between the amplifiers and a coaxial rotary joint, said coaxial rotary joint disposed between the antenna and the aircraft.

11. An array of microwave antennas for an aircraft, each antenna in the array comprising:

a reflector element with reflective surface and a back surface;

a support tube with a rear portion and a front portion, the support tube extending from the reflective surface of the reflector element;

a horn located proximate the rear portion of the support tube and on the front surface of the reflector element;

an orthomode transducer located on the back surface of the reflector element, the orthomode transducer coupled to the horn;

a vertical polarization solid state power amplifier coupled to the orthomode transducer by a first vertical polarization waveguide;

a horizontal polarization solid state power amplifier coupled to the orthomode transducer by a first horizontal polarization waveguide;

a vertical polarization low noise amplifier coupled to the orthomode transducer by a second vertical polarization waveguide; and a horizontal polarization low noise amplifier coupled to the orthomode transducer by second horizontal polarization waveguide.

12. The array according to claim 11, wherein the solid state power amplifiers and the low noise amplifiers further comprise 5 watt amplifiers.

13. The array according to claim 11, wherein the waveguides further comprise ½ height waveguides.

14. The array according to claim 11, wherein a sub-reflector is located proximate a front portion of the support tube.

15. The array according to claim 11, wherein the horn further comprises a corrugated horn.

16. The microwave antenna according to claim 11, further comprising a coaxial adapter disposed between the amplifiers and a coaxial rotary joint, said coaxial rotary joint disposed between he antenna and the aircraft.

* * * * *